United States Patent [19]

Erdmann et al.

[11] Patent Number: 4,503,967

[45] Date of Patent: Mar. 12, 1985

[54] APPARATUS FOR ACCUMULATING ARRAYS OF CIGARETTES OR THE LIKE

[75] Inventors: Otto Erdmann, Hamburg; Reinhard Deutsch, Geesthacht, both of Fed. Rep. of Germany

[73] Assignee: Hauni-Werke Körber & Co. KG, Hamburg, Fed. Rep. of Germany

[21] Appl. No.: 475,851

[22] Filed: Mar. 16, 1983

[30] Foreign Application Priority Data

Apr. 30, 1982 [DE] Fed. Rep. of Germany ..... 3216062

[51] Int. Cl.[3] ..... B65G 47/26

[52] U.S. Cl. ..... 198/419; 198/420; 53/150; 53/151; 53/236

[58] Field of Search ..... 198/418, 419, 420; 53/148, 149, 150, 151, 236; 131/282, 283; 271/220; 414/43

[56] References Cited

U.S. PATENT DOCUMENTS

| | | | |
|---|---|---|---|
| 3,435,940 | 4/1969 | Seragnoli | 198/419 |
| 3,642,112 | 2/1972 | Seragnoli | 198/419 |
| 4,306,648 | 12/1981 | Manservisi et al. | 198/419 |
| 4,341,298 | 7/1982 | Dingli | 198/419 |

FOREIGN PATENT DOCUMENTS

| | | | |
|---|---|---|---|
| 2243911 | 3/1974 | Fed. Rep. of Germany | 53/150 |

*Primary Examiner*—Joseph E. Valenza
*Assistant Examiner*—Jonathan D. Holmes
*Attorney, Agent, or Firm*—Peter K. Kontler

[57] ABSTRACT

Apparatus for accumulating arrays of superimposed layers of parallel cigarettes has a magazine with three layer-accumulating sections having outlets at different levels and a set of pushers which expel layers of cigarettes from the sections during the intervals of dwell of an intermittently driven conveyor for a set of receptacles each of which accumulates an array by accepting one layer from each of the sections. The top and side walls of the receptacles have aligned slots for stationary and movable portions of retaining devices which prevent the cigarettes forming layers of incomplete arrays from moving relative to each other during abrupt acceleration and deceleration of the conveyor to move the receptacles from section to section. The undersides of movable portions of the retaining devices can be raised above or lowered into alignment with the undersides of the adjacent stationary portions through distances approximating the thickness of a layer. The movable portions are disposed in pairs at the second and third sections, and the stationary portions extend along the first section as well as between successive sections. The first movable portions of the two pairs are connected to each other for simultaneous up-and-down movement, the same as the second movable portions of the two pairs. All of the movable portions are lifted simultaneously when the conveyor comes to a halt, and the first portion of each pair is lowered ahead of the respective second portion while the conveyor is in motion.

20 Claims, 2 Drawing Figures

APPARATUS FOR ACCUMULATING ARRAYS OF CIGARETTES OR THE LIKE

BACKGROUND OF THE INVENTION

The present invention relates to apparatus for accumulating arrays of parallel rod-shaped articles, such as plain or filter tipped cigars, cigarillos, cigarettes or cheroots. More particularly, the invention relates to improvements in apparatus for accumulating multi-layer arrays of parallel rod-shaped articles (hereinafter referred to as cigarettes), preferably for accumulating arrays wherein the cigarettes forming the neighboring layers are slightly offset relative to one another so that the cigarettes of one layer extend into the recesses of the adjacent layer or layers. Still more particularly, the invention relates to improvements in apparatus which are designed for stepwise accumulation of multi-layer arrays of cigarettes.

It is already known to accumulate multi-layer arrays of cigarettes in an apparatus which forms part of a cigarette packing machine and wherein a magazine has several sections or units, one for each layer of an array, and wherein each such section or unit is designed to accumulate a succession of layers consisting of closely adjacent parallel cigarettes. A conveyor which supports a series of equidistant receptacles for discrete arrays is caused to advance stepwise past the sections of the magazine so that successive receptacles register with successive sections during successive intervals of dwell of the conveyor. The sections have outlets which are disposed at different levels so that the layer which issues from a next-following section of the magazine can descend onto the layer which was introduced into the same receptacle during dwell of such receptacle in a position of register with the preceding section or unit of the magazine. The magazine cooperates with a composite transfer device which penetrates into the sections during each interval of dwell of the conveyor to transfer from each section a freshly accumulated layer into the receptacle which happens to be in register with the respective section. The conveyor transports the cigarettes sideways, i.e., at right angles to the axes of the cigarettes. Reference may be had to commonly owned U.S. Pat. No. 4,362,235 granted Dec. 7, 1982 to Erdmann, and to commonly owned pending U.S. patent application Ser. No. 421,561 filed Sept. 22, 1982 by Erdmann et al.

The just described mode of accumulating arrays of cigarettes (e.g., customary arrays or blocks of twenty cigarettes each wherein two outer layers contain seven cigarettes each and the median layer contains six cigarettes which are staggered with reference to the cigarettes of the outer layers) is preferred over the earlier modes of gathering such arrays, namely, of accumulating a complete multi-layer block of cigarettes in a single section of the magazine and of thereupon expelling the complete block into the adjacent receptacle of an intermittently driven conveyor. Reference may be had to commonly owned U.S. Pat. No. 4,061,234 granted Dec. 6, 1977 to Bantien et al. The accumulation of a complete multi-layer array in a single section of the magazine takes up much more time than the accumulation of a single layer. In fact, the frequency at which complete multi-layer arrays are accumulated from discrete layers is a multiple of the frequency of gathering multi-layer arrays at a single location.

However, stepwise accumulation of multi-layer arrays by stacking successive layers on top of one another at each of several successive outlets of a magazine in a cigarette packing machine or the like also presents certain serious problems, particularly as regards the retention of cigarettes in incomplete arrays in optimum positions with reference to each other and with reference to the respective receptacles. In order to accumulate a large number of arrays per unit of time, the conveyor which transports the receptacles from section to section of the magazine must be rapidly accelerated and rapidly decelerated at a very high frequency whereby the cigarettes which form part of incomplete arrays in the receptacles are likely to change their orientation (particularly to lie askew) and to prevent the introduction of additional layers and/or undergo deformation of such nature that the resulting arrays must be discarded with attendant losses in output of the packing machine and expenditures for recovery of tobacco shreds from damaged cigarettes.

In accordance with an earlier proposal which is disclosed in the aforementioned commonly owned copending U.S. patent application Ser. No. 421,561 filed Sep. 22, 1982 by Erdmann et al., cigarettes in partly filled receptacles of the intermittently advancing conveyor are held against undesirable movements in response to abrupt acceleration or deceleration of the conveyor by stationary retaining or holding members which are adjacent to the path of movement of the receptacles. The receptacles are dimensioned in such a way that portions of the cigarettes therein are exposed and can be engaged and held by the stationary retaining members. Such retaining members can satisfactorily guide the cigarettes during travel in the spaces between successive outlets of the magazine but are incapable of preventing misalignment of cigarettes in partially filled receptacles during the last stage of deceleration of the conveyor and/or during the initial stage of acceleration of such conveyor, namely, when a partly filled receptacle is about to come to a full halt or is in the process of being accelerated for rapid advancement to the next outlet of the magazine unless the conveyor moves between the retaining members and the magazine. Thus, stationary retaining members cannot be installed in regions which are immediately adjacent to the aforementioned sections or units of the magazine because they would interfere with introduction of fresh layers of cigarettes into partially filled receptacles of the conveyor.

In accordance with another earlier proposal which is disclosed in the commonly owned copending U.S. patent application Ser. No. 470,569 filed Feb. 28, 1983 by Hoffmann et al., the apparatus employs a conveyor with receptacles whose volume or capacity is variable so that the capacity of a receptacle approaching the first section of the magazine barely suffices to receive a single layer, that the capacity of such receptacle is increased to accommodate a second layer when the receptacle comes to a halt in register with the next-following section of the magazine, and so forth. Such apparatus can reliably prevent misalignment of cigarettes forming part of incomplete arrays because the capacity of each receptacle is increased only when the conveyor is at a standstill and only to the extent which is needed to admit a single layer of cigarettes. However, the apparatus must employ a conveyor with receptacles each and every one of which must be adjustable to change its capacity, and the apparatus must also employ means for varying the capacities of successive receptacles at successive outlets of the multiple-outlet magazine. This contributes to complexity, sensitivity, initial cost and maintenance cost of the apparatus.

OBJECTS AND SUMMARY OF THE INVENTION

An object of the invention is to provide a novel and improved apparatus which can accumulate blocks and other arrays of parallel cigarettes or analogous rod-shaped articles with a high degree of accuracy, at a high frequency, and with a minimal number of rejects.

Another object of the invention is to provide an apparatus which embodies the advantages but avoids the drawbacks of heretofore proposed arraying apparatus.

A further object of the invention is to provide the apparatus with novel and improved means for preventing the articles of incomplete arrays from performing undesirable movements in their receptacles as a result of abrupt acceleration and/or deceleration of the conveyor.

An additional object of the invention is to provide novel and improved receptacles for use in the conveyor of the above outlined apparatus.

Another object of the invention is to provide a cigarette packing or analogous machine which embodies the improved arraying apparatus.

Still another object of the invention is to provide the apparatus with novel and improved means for conforming the ability of the receptacles to accept articles to the momentary positions of the receptacles with reference to the source of articles.

A further object of the invention is to provide the apparatus with novel and improved means for preventing undesirable movements of articles during movement across the spaces between successive outlets of the magazine of a packing machine.

Another object of the invention is to provide a novel and improved method of preventing stray movements of rod-shaped articles in those receptacles of the intermittently advancing conveyor which contain only portions of arrays.

The invention resides in the provision of an apparatus for accumulating arrays of predetermined numbers of overlapping layers of parallel cigarettes or analogous rod-shaped articles. The apparatus comprises a magazine which stores a supply of rod-shaped articles and includes a series of equidistant layer-accumulating sections or units with outlet openings for layers disposed at different levels, conveyor means having equidistant receptacles each of which can confine an array, means for moving the conveyor means stepwise in a predetermined direction along a path extending past the magazine sections so that successive receptacles register with successive sections during the intervals of dwell of the conveyor means, means for transferring layers from the magazine sections into the registering receptacles during the intervals of dwell, and article retaining means adjacent to the aforementioned path and including alternating stationary and movable portions, as considered in the direction of movement of the conveyor means, for engaging and holding the articles of the layers in receptacles containing fewer than the predetermined number of layers. The retaining means is preferably disposed at a level above the path for the receptacles and the stationary and movable portions of the retaining means have article-engaging undersides. The apparatus further comprises means for moving the movable portions of the retaining means back and forth, preferably at right angles to the direction of movement of the receptacles along their path.

The sections include a foremost section for accumulation of the first layer of each array and preferably a plurality of additional sections. The movable portions of the retaining means are adjacent to the additional sections of the magazine, and the stationary sections are disposed at the foremost section and also between successive sections of the magazine. The retaining means preferably includes a group of two movable portions adjacent to each of the additional sections, and the aforementioned moving means preferably comprises means for moving the portions of each group relative to one another, preferably substantially vertically during predetermined stages of each stepwise movement of the conveyor means. The first movable portions of each group, as considered in the direction of advancement of the receptacles, are connected to each other for simultaneous up-and-down movement with a first common support, and a second common support connects the second movable portions of the groups for simultaneous movement relative to or simultaneously with the first movable portions. The moving means can comprise driven cam means (e.g., a rotary cam having several tracks in the form of endless grooves) and follower means connected with the movable portions of the retaining means and tracking the cam means.

The receptacles can be provided with aligned slots for the stationary and movable portions of the retaining means; such slots can be provided in the top and side walls of the receptacles.

The sections of the magazine can include one or more sections which accumulate layers containing a first number of parallel articles and one or more sections which accumulate layers containing a different second number of parallel articles.

The receptacles of the conveyor means can be simple constant-capacity or constant-volume receptacles. If the apparatus is to accumulate arrays of twenty cigarettes each, the magazine comprises three sections including two outer sections each of which accumulates layers of seven cigarettes each and a median section which accumulates layers of six cigarettes.

The movable portions of the retaining means can have identical lengths, as considered in the direction of advancement of the receptacles, and the moving means is designed to move the undersides of the movable portions into and from alignment with the undersides of the adjacent stationary portions of the retaining means. The length of stationary portions of the retaining means can exceed that of the movable portions.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
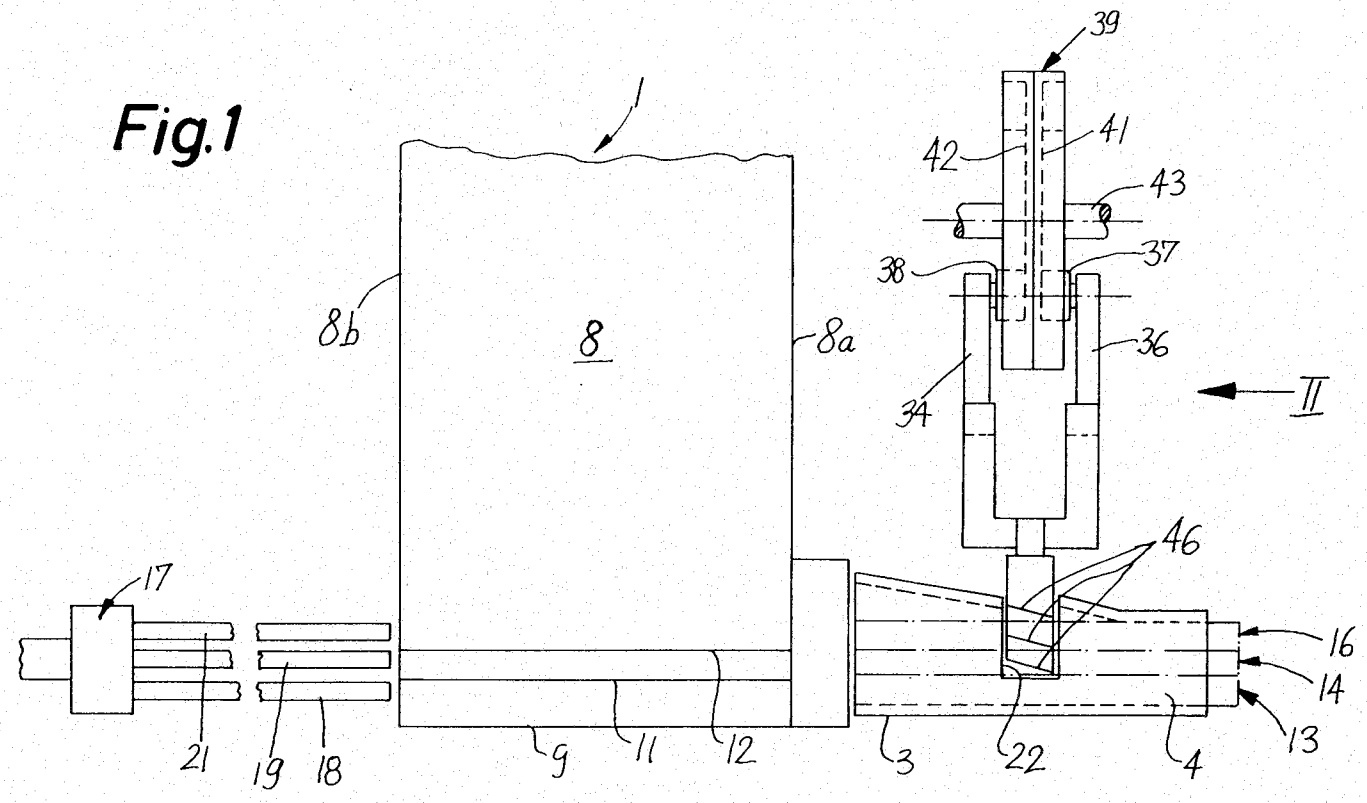
FIG. 1 is a fragmentary side elevational view of an apparatus which embodies one form of the invention and is designed to accumulate arrays of twenty parallel cigarettes each.
Figure 2:
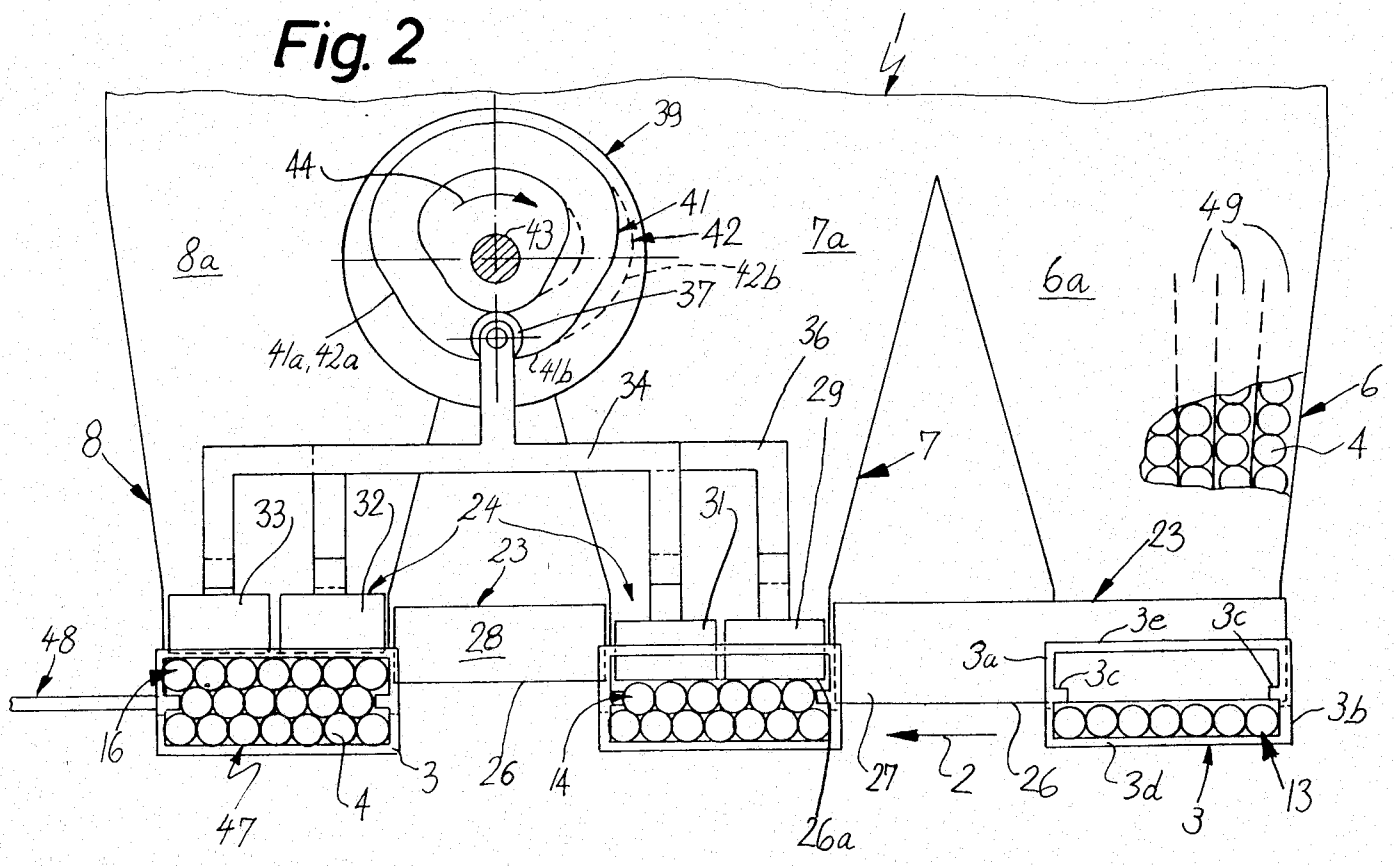
FIG. 2 is a fragmentary front elevational view of the apparatus as seen in the direction of arrow II in FIG. 1.

The apparatus which is shown in FIGS. 1 and 2 is designed to accumulate arrays 47 of twenty cigarettes 4 each. Each fully assembled array 47 comprises three parallel layers 13, 14 and 16 of cigarettes 4. Each of the two outer layers 13, 16 contains seven cigarettes 4, and the intermediate layer 14 contains six cigarettes. The cigarettes 4 of the intermediate layer 14 are staggered with reference to the cigarettes in the outer layers 13, 16 so that the cigarettes forming the three layers are arranged in a so-called quincunx formation.

The illustrated apparatus comprises a magazine 1 and an intermittently driven conveyor 48 which is advanced stepwise in the direction indicated by arrow 2 and comprises a series of equidistant fixed-capacity receptacles 3. Each receptacle 3 can accommodate a full array 47 of twenty cigarettes 4 and the side walls 3*a*, 3*b* of each receptacle 3 are provided with inwardly extending ribs 3*c* which ensure that each intermediate layer 14 is staggered with respect to the layer 13 therebelow. The conveyor 48 is preferably an endless belt or chain conveyor and is driven in stepwise fashion by a geneva drive in a manner well known from the art of conventional cigarette arraying apparatus.

The magazine 1 comprises three discrete sections or units 6, 7, 8 which respectively accumulate and properly support successive layers 13, 14 and 16. To this end, each of the two outer sections 6 and 8 comprises seven upright ducts 49, and each such duct contains an upright row of parallel horizontal cigarettes 4. The median section 7 contains six upright ducts.

The bottom wall 9 of the first or foremost section 6 is disposed at a level below the bottom wall 11 of the median section 7, and the bottom wall 11 is disposed at a level below the bottom wall 12 of the last or rearmost section 8, as considered in the direction (arrow 2) of intermittent advancement of the conveyor 48. The difference between the levels of the bottom walls 9, 11 and 12 can approximate but is normally slightly less than the diameter of a cigarette 4 because the cigarettes of the intermediate layer 14 enter the recesses between the neighboring cigarettes of the lowermost layer 13 and the cigarettes of the uppermost layer 16 descend into the recesses between and at the outer sides of the cigarettes forming the layer 14. Each of the sections 6, 7, 8 has an elongated horizontal first or outlet opening (not specifically shown) which is provided in the front wall or panel 6*a*, 7*a*, 8*a* of the respective section as well as a second opening which is aligned with the respective outlet opening and is provided in the rear wall of the corresponding section (note the rear wall 8*b* of the section 8 shown in FIG. 1). The illustrated upper reach of the conveyor 48 is guided along a horizontal path such that the outlet opening in the wall 6*a* of the foremost section 6 of the magazine 1 can discharge the layer 13 onto the bottom wall 3*d* of the receptacle 3 which is then in register with the section 6, that the outlet opening in the wall 7*a* of the median section 7 can discharge a layer 14 on top of the layer 13 in the receptacle 3 which is in register with the section 7 while the conveyor 48 is at a standstill, and that the outlet opening in the wall 8*a* of the section 8 can discharge a layer 16 on top of the layer 14 in the receptacle 3 which is in register with the section 8 when the conveyor 48 is at a standstill.

The apparatus also comprises a transfer device 17 which is normally located behind the magazine 1 and comprises several prongs or pushers 18, 19, 21, one for each second opening of the magazine 1. The lowermost pusher 18 can expel a layer 13 through the outlet opening in the wall 6*a* of the section 6 and into the adjacent receptacle 3 wherein the layer constitutes the sole and lowermost layer; the pusher 19 can expel layers 14 from the section 7 so that such layers enter successive receptacles 3 which dwell at the station accommodating the section 7 while the conveyor 48 is idle; and the pusher 21 can expel a layer 16 from the section 8 into the adjacent receptacle 3 to thus complete the accumulation of an array 47. Still further, the transfer device 17 comprises an additional pusher (not shown) which is located to the left of the section 8, as viewed in FIG. 2, and serves to expel successive arrays 47 from the respective receptacles 3, e.g., into the hollow mandrels of a conveyor forming part of a cigarette packing machine, e.g., a machine described and shown in commonly owned U.S. Pat. No. 3,750,676 to Kruse et al. or in commonly owned U.S. Pat. No. 3,956,870 to Kruse et al. The disclosures of all patents and patent applications which are mentioned herein are incorporated by reference. The station where a further pusher of the transfer device 17 expels successive arrays 47 from the respective receptacles 3 can be disposed close to or at a greater distance from the section 8, depending on the design of the packing machine and the locus of the station where the machine transfers fully assembled arrays 47 into hollow mandrels or directly into prefabricated packets.

Each of the receptacles 3 has an inverted U-shaped cutout or slot 22 which extends across its top wall 3*e* and halfway down into its side walls 3*a*, 3*b*. The slots 22 of successive receptacles 3 are aligned, as considered in the direction of arrow 2, and such slots serve to receive portions of a stationary cigarette holding or retaining device 23 as well as vertically movable or adjustable portions of a mobile or adjustable cigarette holding or retaining device 24. The stationary retaining device 23 includes two portions or components 27 and 28 the first (27) of which extends along the section 6 as well as between the sections 6 and 7 of the magazine 1. The second portion 28 of the stationary retaining device 23 extends between the sections 7 and 8 of the magazine 1. The purpose of the portion 27 is to prevent the cigarettes 4 of the layer 13 in the receptacle 3 therebelow from moving relative to one another in spite of the fact that the conveyor 48 comprises constant-capacity receptacles 3. The purpose of the portion 28 is to prevent the cigarettes 4 of successive partially assembled arrays (namely, the cigarettes of the layers 13, 14) from moving relative to one another during travel of a receptacle 3 in the space between the sections 7 and 8 of the magazine 1. The front bottom edge 26 of the stationary retaining portion 27 is disposed at a level which is barely high enough to ensure that the layer 13 in a receptacle 3 which contains a single layer of cigarettes 4 can readily advance from a position of full registry with the section 6 toward a position of registry with the section 7, and the front bottom edge 26 of the stationary retaining portion 28 is disposed at a level which ensures that the layers 14 can barely advance therebelow on their way with the respective receptacles 3 from register with the section 7 toward register with the section 8. The difference between the levels of the front bottom edges 26 of the portions 27 and 28 is slightly less than the diameter of a cigarette.

The mobile or adjustable holding or retaining device 24 comprises a first group of parts or components at the station accommodating the section 7, and a second group of parts or components at the station accommodating the section 8 of the magazine 1. The first group includes two movable portions 29, 31 which are movable relative to each other, and the second group includes two movable portions 32, 33 which are also movable relative to one another. The portions 29 and 32 are mounted on the downwardly extending arms of a first vertically movable inverted U-shaped support 36, and the portions 31, 33 are mounted on the downwardly extending arms of a second vertically movable inverted U-shaped support 34. The portions 29, 31 are movable into the slot 22 of the receptacle 3 at the station accommodating the section 7, and the portions 32, 33 are movable into the slot 22 of the receptacle 3 at the station for the section 8 of the magazine 1.

The means for moving the supports 34 and 36 up and down comprises a composite grooved cam 39 which has two endless cam grooves 41 and 42 and is rotatable by a camshaft 43 receiving motion from the main prime mover of the packing machine in synchronism with movements of the transfer device 17. The horizontal web of the support 34 carries a roller follower 38 which extends into the groove 42, and the web of the support 36 carries a roller follower 37 which extends into the groove 41 of the cam 39. The configuration of the cam groove 41 can resemble that of the cam groove 42; however, the two cam grooves are angularly offset with reference to each other (note FIG. 2) so that the supports 34 and 36 move relative to one another, at least during certain stages of each revolution of the cam 39. The direction in which the camshaft 39 rotates the cam 39 is indicated by the arrow 44. Each of the cigarette retaining portions 27, 28, 29, 31, 32 and 33 has a suitably inclined (forwardly and downwardly sloping) underside 46 (see FIG. 1) to avoid damage to the leaders of cigarettes 4 which form the layers 13, 14, 16 during introduction of such layers into the registering receptacles 3.

The operation is as follows:

The sections 6, 7 and 8 of the magazine 1 continuously accumulate horizontal layers 13, 14 and 16 which come to rest on the respective bottom walls 9, 11, 12 in register with the corresponding outlet openings in the front walls 6*a*, 7*a* and 8*a*. The width of each outlet opening matches or only slightly exceeds the width of the respective layer 13, 14 or 16. The cigarettes 4 of each layer are parallel to one another and are preferably in actual contact. The accumulation of successive layers 13, 14 and 16 in the respective sections 6, 7 and 8 of the magazine 1 takes place by gravity, and the ducts 49 ensure that each of a long or short series of successive layers which are formed in the respective section of the magazine 1 contains the same number of cigarettes 4 in optimum orientation for introduction into a receptacle 3.

FIG. 2 shows the conveyor 48 during an interval of idleness. At such time, each of the magazine sections 6, 7 and 8 is in accurate register with one of three successive receptacles 3. More particularly, the outlet opening in the front wall 6*a* is in exact register with the lower third of the compartment in the adjacent receptacle 3, the outlet opening in the front wall 7*a* is in exact register with the central third of the compartment in the adjacent receptacle 3, and the outlet opening in the front wall 8*a* is in exact register with the top third of the compartment in the corresponding receptacle 3. The transfer member 17 performs a forward stroke (in a direction to the right, as viewed in FIG. 1) when the conveyor 48 comes to a halt whereby the pushers 18, 19 and 21 respectively transfer discrete layers 13, 14 and 16 into the aligned receptacles 3. Each layer 14 is formed and located at a level above the layers 13 but below the layers 16. As can be seen in FIG. 2, the freshly admitted layer 13 comes to rest on the bottom wall 3*d* of the respective receptacle 3, the freshly transferred layer 14 comes to rest on the layer 13 in the respective receptacle, and the layer 16 comes to rest on the layer 14 in the registering receptacle of the conveyor 48. The latter is thereupon set in motion by the prime mover which also transmits motion to the camshaft 43 and to the transfer device 17 so that the conveyor 48 is abruptly accelerated and thereupon abruptly decelerated in order to complete the transport of receptacles 3 by a step within a very short interval of time, i.e., to accumulate complete arrays 47 at a high frequency. This means that the cigarettes 4 in the partially filled receptacles 3 (leaving the stations for the sections 6 and 7 of the magazine 1) exhibit a pronounced tendency to leave their optimum positions as a result of abruptly developing accelerating and decelerating forces. The cigarettes 4 in the layer 13 leaving the station for the foremost magazine section 6 are prevented from changing their positions relative to the respective receptacle 3 by the front bottom edge face 26 of the first portion 27 of the stationary retaining device 23 while the layer 13 advances from the position of registry with the outlet opening in the front wall 6*a* toward the position at a level below the outlet opening in the front wall 7*a*. During such stepwise advance of the conveyor 48, the portions 29, 31 of the movable retaining device 24 are moved below the levels shown in FIG. 2 so that their front bottom edges 26*a* are flush with the front bottom edge 26 of the portion 27. Consequently, the portions 29 and 31 prevent the cigarettes 4 of the layer 13 in the receptacle 3 which has just left the station for the magazine section 6 from becoming misaligned during that stage of their movement into the station for the magazine section 7 which takes place after the layer 13 advances beyond the underside 46 of the stationary portion 27. Thus the stationary portion 27 of the device 23 cooperates with the movable portions 29, 31 to ensure that the cigarettes 4 of the layer 13 cannot change their positions during advancement of the respective receptacle 3 from exact registry with the outlet opening in the front wall 6*a* to exact registry with the outlet opening in the front wall 7.

Since the movable portions 29 and 31 are respectively connected with the movable portions 32 and 33, lowering of the portions 29 and 31 to positions of alignment with the stationary portion 27 necessarily entails a lowering of portions 32 and 33 to positions of alignment with the portion 28 of the stationary retaining device 23. Therefore, the cigarettes 4 of the layer 14 which is admitted at the station for the median magazine section 7 are held against any stray movements while the receptacle 3 accommodating the layers 13 and 14 advances from a position of accurate alignment with the outlet opening in the front wall 7*a* to a position of accurate alignment with the outlet opening in the front wall 8*a*.

Those portions of the cam grooves 41 and 42 in the cam 39 which cause the respective roller followers 37 and 38 to lower the corresponding supports 36 and 34 are angularly offset with reference to each other in such a way that the support 36 lowers the movable portions 29 and 32 before the support 34 lowers the movable portions 31 and 33. The portions 29 and 32 can be lifted to the levels which are shown in FIG. 2 as soon as the trailing portion of a layer 14 (as viewed in the direction of arrow 2) advances beyond one half of the outlet opening in the front wall 7*a* and the trailing portion of the layer 16 advances beyond one-half of the outlet opening in the front wall 8*a*. The portions 31 and 33 are lifted to the levels shown in FIG. 2 as soon as the conveyor 48 is arrested, i.e., as soon as the receptacle 3 with a single layer 13 therein moves into full register with the section 7 and the receptacle containing only two layers (13 and 14) moves into full register with the section 8 of the magazine 1. This ensures that the cigarettes 4 in the receptacle 3 which contains a single layer (13) and the cigarettes in the receptacle 3 which contains only two layers (13 and 14) are not permitted to change their mutual positions during abrupt acceleration and/or during abrupt deceleration of the conveyor 48.

As soon as the portions 31 and 33 of the movable retaining device 24 are lifted to the positions shown in FIG. 2 (the portions 29 and 32 can be held in the illustrated positions at the time of lifting of the portions 31 and 33), the receptacles 3 which register with the sections 7 and 8 are respectively ready to receive layers 14 and 16. The empty receptacle 3 at the station for the magazine section 6 is ready to receive a layer 13 because it is located in front of the right-hand part of the portion 27 of the stationary retaining device 23. The transfer device 17 then performs a forward stroke and its pushers 18, 19, 21 introduce layers 13, 14 and 16 into the respective receptacles. During the next-following advancement of the conveyor 48, the portions 29 and 32 can be lowered by the cam 39 via follower 37 and support 36 ahead of the portions 31 and 33, namely, as soon as the trailing portions of the layers 14 and 16 advance beyond the portions 29, 31 and before the leader of the freshly introduced layer 13 reaches the station for the magazine section 7 as well as before the leader of the layer 14 reaches the station for the magazine section 8. This ensures that the cigarettes 4 at the leading ends of the layers 13 and 14 (as considered in the direction of arrow 2) are guided by the undersides 46 of the portions 29 and 32 as soon as they enter the stations for the respective magazine sections 7 and 8. The portions 31 and 33 can descend shortly thereafter so that they, too, properly guide the leaders of the layers 13 and 14 during the last stage of movement of the corresponding receptacles 3 into full alignment with the sections 7 and 8.

The configuration of the cam grooves 41 and 42 can be such that all of the movable portions 29, 31, 32 and 33 are simultaneously raised to the positions which are shown in FIG. 2, namely, when the conveyor 48 is at a standstill. In other words, the portions 29, 32 can be lowered ahead of the portions 31, 33 and the portions 29, 32 can be raised simultaneously with the portions 31, 33. The cam grooves 41 and 42 which are shown in FIG. 2 are designed to effect the just mentioned mode of operation of the mobile retaining device 24. Simultaneous lifting of the portions 29, 32 and 31, 33 takes place when the followers 37, 38 respectively track the portions 41*a*, 42*a* of the grooves 41, 42 and staggered lowering of the portions 29, 32 and 31, 33 takes place when the followers 37 and 38 respectively track the portions 41*b* and 42*b* of the cam grooves 41, 42.

When the cigarette retaining portions 29, 32 and 31, 33 assume their upper end positions, the conveyor 48 is started again to advance the receptacles 3 by a step whereby the portion 27 guides the layer 13 during movement toward the position of full register with the station for the section 7, and the portion 28 guides the layer 14 during movement toward a position of full alignment with the section 8 of the magazine. The movable portions 29, 31 descend in time to guide the layer 13 during the last two stages of movement into register with the outlet opening in the front wall 7*a*, and the movable portions 32, 33 descend in time to guide the layer 14 during the last stage of movement toward full register with the outlet opening in the front wall 8*a*.

As mentioned above, a further pusher of the transfer device 17 expels successive arrays 47 from the corresponding receptacles 3 during successive intervals of dwell of the conveyor 48.

The improved apparatus can be modified by omitting the slots 22 in the receptacles 3 and by placing the stationary and mobile retaining devices 23 and 24 adjacent to those portions of the cigarettes 4 which extend beyond the respective receptacles. As shown in FIG. 1, the cigarettes 4 extend beyond the right-hand ends of the receptacles 3. However, it is also possible to install the stationary and movable retaining devices between the conveyor 48 and the front walls 6*a*, 7*a*, 8*a* of the magazine 1; all that is necessary is to select the distance between the conveyor 48 and the magazine 1 as well as the working stroke of the transfer device 17 in such a way that the rear end portions of the cigarettes forming the layers 13, 14 and 16 extend beyond those ends of the receptacles 3 which face the magazine.

An important advantage of the improved apparatus is that it ensures the retention of cigarettes 4 in the layers 13 and 14 in optimum positions during each and every stage of movement of the conveyor 48, irrespective of abruptness of the acceleration and/or deceleration of the conveyor. Furthermore, such retention of cigarettes 4 in optimum positions is achieved in spite of the fact that the conveyor 48 comprises very simple and inexpensive receptacles, i.e., a receptacle need not have one or more walls which are movable relative to the other wall or walls in order to vary the capacity of the receptacle during certain stages of accumulation of an array of cigarettes therein.

It will be noted that stationary retaining portions 27 and 28 alternate with mobile retaining portions 29, 31 and 32, 33, as considered in the direction of movement of the conveyor 48 and of its receptacles 3 along the front side of the magazine 1. The movable portions 29, 31 and 32, 33 are respectively disposed at the stations for the magazine sections 7 and 8, i.e., at the stations where successive receptacles 3 respectively receive the second (14) and third (16) layers of the corresponding arrays 47. The stationary portion 27 is disposed between the first and second stations, and the stationary portion 28 is disposed between the second and third stations, as considered in the direction of arrow 2. In addition, the first or foremost stationary portion 27 extends along the first station (magazine section 6) to thus ensure that the cigarettes 4 of the freshly introduced layer 13 cannot move relative to each other and/or relative to the corresponding receptacle 3.

The provision of groups or pairs of movable portions (29, 31 and 32, 33) at the stations for the magazine sections 7 and 8 renders it possible to reduce the spacing between the sections 6, 7, 8 and the spacing between the receptacles 3 of the conveyor 48, i.e., to reduce the distance which the conveyor 48 must cover between successive intervals of dwell. This also contributes to more rapid accumulation of the arrays 47. The feature that the portions 29, 31 and 32, 33 are respectively movable relative each other and are lowered during different stages of advancement of the receptacles 3 from station to station ensures that the leaders of oncoming layers 13 and 14 are properly guided during advancement into the stations for the magazine sections 7 and 8 while the trailing portions of the preceding topmost layers are properly guided during the last stage of their movement beyond the respective stations. The number of movable cigarette retaining portions at the stations for the magazine sections 7 and 8 could be increased to more than two. It has been found that the illustrated embodiment constitutes a highly advantageous compromise between a substantial reduction of the spacing between neighboring receptacles 3 of the conveyor 48 and reasonable simplicity of the apparatus, especially of the means for effecting the movements of movable portions of the retaining device 24 between their raised and lowered positions as well as with reference to each other. The same holds true for the provision of common supports (36 and 34) for pairs of movable retaining portions (29, 32 and 31, 33). Mounting of the retaining devices 23 and 24 in such positions that they can engage the layers 13 and 14 by extending through slots 22 which are disposed substantially midway between the open ends of the respective receptacles 3 also contributes to simplicity and reliability of the apparatus because the movable and stationary retaining portions engage the cigarettes 4 of the layers 13 and 14 substantially midway between the ends of the cigarettes so that the cigarettes are least likely to change their mutual positions as a result of abrupt acceleration or deceleration of the conveyor 48.

An additional advantage of the improved apparatus is that the stationary and movable retaining devices are disposed at one and the same side of the path of movement of the receptacles 3 along the front side of the magazine 1. In the illustrated embodiment, the devices 23 and 24 are disposed above such level. This contributes to simplicity of the apparatus and to ready accessibility of the retaining devices. In has been found that the retaining devices 23 and 24 treat the cigarettes 4 gently, even at a very high frequency of intermittent movement of the conveyor 3, so that the condition of the constituents of arrays 47 is not affected by the aforediscussed guidance of layers 13 and 14 during transport between and at the stations for the magazine sections 6, 7 and 7, 8.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for accumulating arrays of predetermined numbers of overlapping layers of parallel cigarettes or analogous rod-shaped articles, comprising a magazine arranged to store a supply of rod-shaped articles and including a series of equidistant layer-accumulating sections with outlet openings for layers disposed at different levels; conveyor means having equidistant receptacles each arranged to confine an array, said conveyor means being movable stepwise in a predetermined direction along a path extending past said sections so that successive receptacles register with successive sections during the intervals of dwell of the conveyor means; means for transferring layers from said sections into the registering receptacles during said intervals of dwell; and article retaining means adjacent to said path and including alternating stationary and movable portions, as considered in said direction, arranged to engage and hold the articles of the layers in receptacles containing fewer than said predetermined number of layers.

2. The apparatus of claim 1, wherein said portions of the retaining means have article-engaging undersides.

3. The apparatus of claim 1, further comprising means for moving the movable portions of said retaining means back and forth substantially at right angles to the direction of movement of receptacles along said path.

4. The apparatus of claim 1, wherein said sections include a foremost section for accumulation of the first layer of each array and a plurality of additional sections, said movable portions of said retaining means being adjacent to said additional sections.

5. The apparatus of claim 1, wherein said sections include a foremost section for accumulation of the first layer of each array and a plurality of additional sections, said stationary portions of said retaining means being disposed at said first section as well as between said sections.

6. The apparatus of claim 5, wherein said movable portions are adjacent to said additional sections.

7. The apparatus of claim 1, wherein said retaining means includes groups of movable portions adjacent to certain sections of said magazine.

8. The apparatus of claim 7, further comprising means for moving the portions of each of said groups relative to one another.

9. The apparatus of claim 8, wherein each of said groups comprises two movable portions and said moving means comprises means for moving the movable portions of each group substantially vertically and relative to one another during predetermined stages of each stepwise movement of said conveyor means.

10. The apparatus of claim 8, wherein each of said groups includes a first and a second movable portion, as considered in said direction, said moving means comprising means for simultaneously moving said first portions and means for simultaneously moving said second portions.

11. The apparatus of claim 8, wherein said moving means comprises driven cam means and follower means connected with said movable portions and tracking said cam means.

12. The apparatus of claim 11, wherein said cam means comprises a rotary cam having a plurality of endless tracks, one for each of said follower means.

13. The apparatus of claim 1, wherein said receptacles have aligned slots and said portions of said retaining means extend into such slots.

14. The apparatus of claim 13, wherein said retaining means is disposed at a level above said path and said receptacles have top and side walls, said slots being provided in the top and side walls of said receptacles.

15. The apparatus of claim 1, wherein said path is at least substantially horizontal and said sections include first and second sections respectively arranged to accumulate layers containing first and second numbers of parallel articles.

16. The apparatus of claim 1, wherein said receptacles are constant-capacity receptacles.

17. The apparatus of claim 1, wherein said magazine comprises three sections including two outer sections each arranged to accumulate layers containing seven parallel articles and a median section arranged to accumulate layers containing six parallel articles.

18. The apparatus of claim 1, wherein the length of said movable portions deviates from the length of said stationary portions, as considered in said direction.

19. The apparatus of claim 1, wherein said movable portions have identical lengths, as considered in said direction.

20. The apparatus of claim 1, further comprising means for moving the movable portions of said retaining means into and from alignment with selected stationary portions.

* * * * *